US005102507A

United States Patent [19]

Wieserman et al.

[11] Patent Number: 5,102,507

[45] Date of Patent: Apr. 7, 1992

[54] METHOD OF MAKING AN ANODIC PHOSPHATE ESTER DUPLEX COATING ON A VALVE METAL SURFACE

[75] Inventors: Larry F. Wieserman; Karl Wefers, both of Apollo; Gary A. Nitowski, Natrona, all of Pa.

[73] Assignee: Aluminum Company of America, Pittsburgh, Pa.

[21] Appl. No.: 422,077

[22] Filed: Oct. 16, 1989

[51] Int. Cl.[5] ..... C25D 11/06

[52] U.S. Cl. ..... 205/153; 156/151; 205/201; 205/220; 205/318; 205/332

[58] Field of Search ..... 204/27, 28, 37.6, 38.3, 204/58; 156/150, 151

[56] References Cited

U.S. PATENT DOCUMENTS

| | | | |
|---|---|---|---|
| 3,013,904 | 12/1961 | Cupery | 117/76 |
| 3,799,848 | 3/1974 | Kolic et al. | 204/38 |
| 4,308,079 | 12/1981 | Venables et al. | 148/6.15 |
| 4,381,226 | 4/1983 | Gillich et al. | 204/14 |
| 4,383,897 | 5/1983 | Gillich et al. | 204/33 |
| 4,388,156 | 6/1983 | Gillich et al. | 204/14 |
| 4,399,021 | 8/1983 | Gillich et al. | 204/38 |
| 4,448,647 | 5/1984 | Gillich et al. | 204/33 |
| 4,788,176 | 11/1988 | Wieserman et al. | 502/401 |

FOREIGN PATENT DOCUMENTS

| | | |
|---|---|---|
| 3305354 | 8/1984 | Fed. Rep. of Germany . |
| 58-006639 | 2/1983 | Japan . |

*Primary Examiner*—John Niebling
*Assistant Examiner*—William T. Leader
*Attorney, Agent, or Firm*—Andrew Alexander

[57] ABSTRACT

A process is disclosed for treating the surface of a valve metal such as aluminum to form a two layer protective coating thereon using an anodizing bath consisting essentially of an aqueous solution having a concentration ranging from about 0.001 molar to a saturated solution of a phosphorus-containing compound selected from the class consisting of a phosphorus acid ester and salts thereof. A non-porous barrier valve metal oxide layer is formed on a surface of the valve metal, and a functionalized layer comprised of a phosphate ester is formed on the oxide layer. The functionalized layer protects the oxide layer against chemical attack by the electrolyte during anodizing 40 Claims, 2 Drawing Sheets

ANODIZATION WITH PHENYLPHOSPHORIC ACID

ANODIZATION - PHENYLPHOSPHATE DIEMETHYL ESTER

ANODIZATION WITH PHENYLPHOSPHATE Na SALT

METHOD OF MAKING AN ANODIC PHOSPHATE ESTER DUPLEX COATING ON A VALVE METAL SURFACE

BACKGROUND OF THE INVENTION

1. Field of the Invention

This invention relates to a process for anodically forming a duplex coating on the surface of a valve metal such as aluminum and products resulting therefrom. More particularly, this invention relates to an anodically formed protective coating on a valve metal surface which comprises a duplex layer of metal oxide directly bonded to the valve metal surface and a functionalized layer of a phosphate ester chemically bonded to the metal oxide.

2. Description of the Related Art

It is well known to anodize valve metals such as aluminum in electrolytes containing acids such as sulfuric, chromic, oxalic and phosphoric acid to achieve a porous metal oxide coating, i.e., a porous aluminum oxide coating, which will protect the metal, provide a decorative appearance or facilitate subsequent adhesive bonding to the metal surface.

U.S. Pat. Nos. 4,388,156, 4,381,226, 4,448,647, 4,399,021, 4,383,897, 4,308,079 and West German Patent 3,305,354 describe processes for treating aluminum with organic and inorganic acids.

In the present invention, it has been discovered that a duplex coating can be applied to a valve metal surface in a single process. The coating comprises a layer of anodically formed valve metal oxide and a layer which is comprised of the reaction product of phosphoric acid esters.

SUMMARY OF THE INVENTION

It is, therefore, an object of this invention to provide a process for forming a chemically resistant coating on the surface of a valve metal such as aluminum which comprises a first layer of a nonporous valve metal oxide and a second layer comprised of a reaction product of monomeric or polymeric phosphoric acid ester (mono-, di- and tri-) and salts thereof, or a combination of such acids.

It is another object of this invention to provide a process for forming a chemically resistant coating on the surface of a valve metal such as aluminum which comprises a first layer of a nonporous valve metal oxide and a second layer comprised of the reaction product of phosphoric acid ester (mono-, di- and tri-) and salts thereof, or a combination of such acids by anodizing the valve metal surface in an electrolyte comprising a soluble phosphoric acid ester, or a combination of such acids, to form a two layer coating on the valve metal surface.

It is yet another object of this invention to provide a process for forming a chemically resistant coating on the surface of a valve metal such as aluminum which comprises a first layer of a nonporous valve metal oxide on the surface of the aluminum and a second layer (which may be a monomolecular layer) of phosphate esters, or a combination thereof, by anodizing the valve metal surface in an electrolyte comprising a water soluble phosphate ester or salt thereof, or combinations of such acids, under constant voltage conditions in the range of about 50 to about 100 volts, depending upon the desired coating thickness, until the current density falls to a level indicative of the fact that a nonporous aluminum oxide coating having a thickness of about 14 Å/V has been formed, to form the two layer coating on the aluminum surface.

It is a further object of this invention to provide a process for forming a chemical or hydration resistant coating on the surface of aluminum which comprises a first layer of a nonporous aluminum oxide and a second layer comprised of the reaction product of phosphoric acid ester (mono-, di- and tri-) and salts thereof, or combinations of such acids, by anodizing the aluminum surface in an electrolyte comprising a water soluble phosphoric acid ester (mono-, di- and tri-) and salts thereof, or combinations of such acids, under constant voltage conditions of from about 1 to about 400 volts, preferably from about 30 to about 90 volts, depending upon the desired coating thickness, until the current density falls to a level indicative of the fact that a nonporous aluminum oxide coating having a thickness of about 14 Å/V has been formed, to form the two layer coating on the aluminum surface.

These and other objects of the invention will be understood from the following description and accompanying flow sheet.

DETAILED DESCRIPTION OF THE INVENTION

Figure 1:
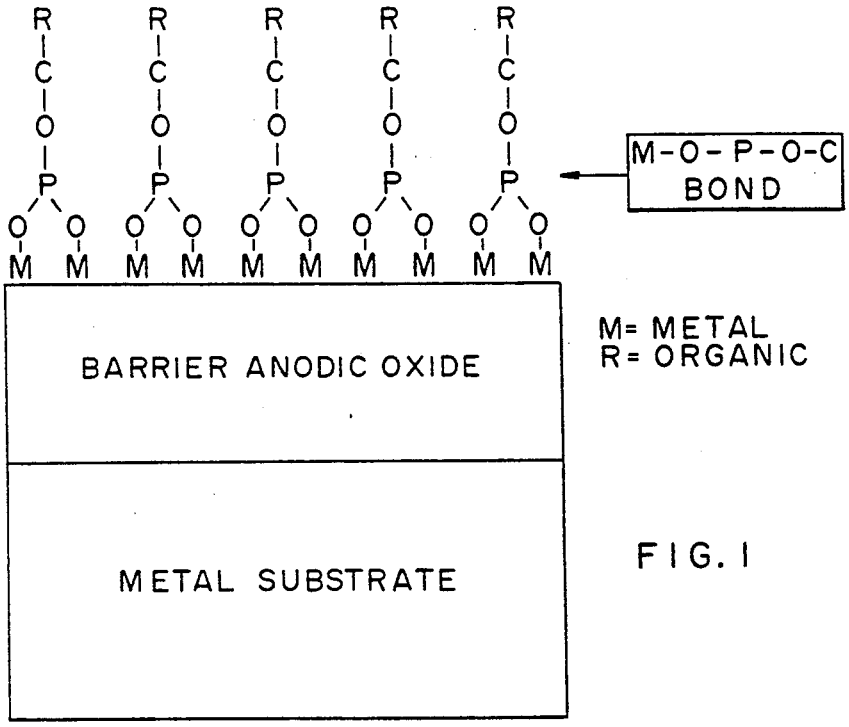
FIG. 1 illustrates the R groups in the functionalized layer extending away from the surface.

In accordance with the invention, the surface of a valve metal such as aluminum is treated to form a protective coating thereon comprising a valve metal oxide and a layer bonded thereto consisting essentially of a reaction product of a phosphorus-containing organic acid selected from the class consisting of phosphoric acid ester (mono-, di- and tri-) and salts thereof, or a combination of these acids. The coating formed by the process of the invention exhibits a preferred orientation of the reaction product, e.g., phosphate esters, such that the phosphorus groups are attached to the valve metal oxide surface while the R groups extend away from that surface, as illustrated in FIG. 1.

Phosphoric acid esters as used herein is meant to include mono-, di-, tri- to dodeca- phosphoric acid radicals and both monomeric and polymeric phosphoric acid esters, and salts thereof are useful in the invention. Phosphoric acid esters may be defined by the formula: $(RO)_m[PO(OH)_2]_n$ or $(RO)_m(R'O)_k[PO(OH)]_n$ or $(RO)_m(R'O)_k(R''O)_q[PO]_n$ wherein R is one or more radicals having a total of 1–30 carbons; R′ and R″ is one or more radicals having a total of 1–30 carbons; m, k or q is the number of radicals RO, R′O or R″O, respectively, in the molecule and is in the range of 1–12; n is the number of phosphoric acid groups in the molecule and is in the range of 1–12.

Non-porous coating or layer as used herein means electrically insulating at a given voltage, i.e., current flow approaches zero, at 50 volts, for example. However, at 75 volts, current flows until the layer gets thicker, and again, the current flow approaches zero. In addition, the oxide has no visible pores as would be present in sulfuric acid anodized material, e.g., aluminum.

Aluminum oxide is used herein to include natural aluminum oxide as well as any anodized layer having less than 15% hydroxyl groups and preferably less than 5%.

Functionalized layer as used herein means a layer which can have a chemical reactivity ranging from non-reactive to very reactive and which can be acid and base resistant, exhibit hydrophobicity or hydrophilicity and be hydration resistant.

By hydration resistant coating is meant the functionalized layer of phosphate ester bonded to a nonporous coating of substantially pure valve metal oxide such as aluminum oxide, e.g., with substantially no detectable electrolyte molecules present in the nonporous aluminum oxide layer when analyzed by Auger Electron Spectrometry.

The valve metal surface to be treated may be in the form of foil, sheet, plate, extrusion, tube, rod or bar. The valve metal may comprise aluminum, antimony, beryllium, bismuth, germanium, hafnium, magnesium, niobium, tantalum, tin, titanium, tungsten or zirconium. The use of specific metals, e.g., aluminum, herein is meant to include alloys thereof. Suitable aluminum alloys may be found in Aluminum Association alloy series AA1000, AA3000 and AA5000. Examples of particular aluminum alloys are AA5042, AA5082, AA5182 and AA5352. The valve metal may comprise a pure valve metal, which may be defined as such a valve metal with a purity of at least 99 wt.%, or a valve metal base alloy, i.e., a valve metal alloy containing at least 50 wt.% of the valve metal. When the valve metal comprises a valve metal base alloy, the alloy may comprise two or more of the above valve metals alloyed together or it may comprise one or more of the above valve metals alloyed with one or more alloying elements or impurities such as, by way of example and not of limitation, silicon, iron, copper, manganese, magnesium, molybdenum, chromium, nickel, zinc, gallium, vanadium, titanium, boron, lithium and zirconium.

The form of the aluminum surface may be planar, curved or in any other shape which will not interfere with formation of the dual layered protective coating thereon.

It will, therefore, be understood that the use of the term aluminum surface herein is intended to include all such defined aluminum materials and shapes.

The liquid used in the treatment of the aluminum surface preferably comprises an aqueous or water containing solution with a range of concentration of from about 0.001 molar to a saturated solution, preferably about 0.1 to about 2 molar, of one or more 2–30 carbon, preferably 2–12 carbon, water soluble monomeric phosphoric acid ester (mono-, di- and tri-) and salts thereof, or mixtures of the same. Salts of the phosphoric acid ester useful in the present invention include salts containing ammonia, alkali metals such as sodium, potassium, and lithium, alkaline earth metals such as magnesium and calcium, and transition metals.

Both monomeric and polymeric materials containing phosphoric acid esters are useful in the invention. Representative of the polymeric phosphoric acid esters are polyvinyl phosphonic acid ester, dodecylpolyoxy ethylene phosphoric acid ester, phosphate-containing polymers, phosphorylated starch, complex sugars and cellulose, Fyrol 99, Fyrol 51, Tex-Wet 1131, phosphate esters of polyvinyl alcohols, polyacrylamides, homopolymers and random polymers of amino acids, polyethylene glycol, polynucleotides, polyoxyethylene and polystyrene.

Representative of monomeric phosphate esters are tris(dibromopropyl) phosphate, tris(β-chloroethyl) phosphate, Thermolin 101, Phosgard 1227, Tricresyl phosphate, polyaryl phosphate, bis(β-chloroethyl) vinylphosphonate, octyl phosphate, dioctyl phosphate, trioctyl phosphate, glycerol 1-phosphate, phosphonenolpyruvate, glucose 1-phosphate, pantothenic acid, phytic acid, Ethfac®, Klearfac®, acetyl phosphate, adensosine 2',5'-diphosphate, 3'-Adenylic acid, adenylosuccinic acid, Agrocin 84, 2-(phosphonooxy)-bezoic acid, picosforic acid, mono (2-cyanophenyl)-phosphate, Meonomycin and vinyl phosphoric acid ester.

Other examples of groups which may comprise R and/or R' include long and short chain aliphatic hydrocarbons, aromatic hydrocarbons, carboxylic acids, aldehydes, ketones, amines, amides, thioamides, imides, lactams, anilines, pyridines, piperidines, carbohydrates, esters, lactones, ethers, alkenes, alkynes, alcohols, nitriles, oximes, organosilicones, ureas, thioureas, perfluoro organic groups, methacrylates, and combinations of these groups.

The phosphoric acid ester (mono-, di- and tri-) and salts thereof, such as listed above may also include inorganic groups substituted thereon such as phosphates, and the like, or groups such as phosphonates, sulfonates, or carbonates. While it is preferred that the free end of the organic group extends away from the aluminum oxide/hydroxide surface, it is within the scope of the present invention to provide, on the free end of the molecule, functional groups. The term functional group may be defined as the group on the molecule which enables the phosphate ester molecule to be bonded to the aluminum oxide surface to react with, attract, couple to, or bond with, etc., other atoms, ions and/or molecules. By attaching specific functional groups, either organic or inorganic, to the R, R' and R'' groups of the phosphate esters, a wide variety of surface characteristics can be achieved.

Functional groups attached to the free end of the phosphate ester molecules may include, but are not limited to, for example, functional groups such as —$HSO_3$, —COONa, —$NH_2$, —SH, —CH=$CH_2$, —OH and —CN. Examples of other functional groups which may be bonded to the free end of the phosphate ester molecules may include, for example, a carboxyl group, a glucose group, a cyano group, a cyanate group, isocyanate group and thiocyanate group, a phenyl group, a diphenyl group, a tertiary butyl group, a sulfonic group, a benzyl sulfonic group, a nitrate group, a phosphate group, a phosphinate group, a phosphinite group, a phosphonate group, a quaternary ammonium salt group and combinations of these groups.

It should be noted that the free end of the phosphate ester molecules may be further reacted after formation of the protective layer on the aluminum surface to provide the desired functionalization of the molecule discussed above if such functionalization of the phosphoric acid ester prior to treatment of the aluminum surface would interfere with such treatment or with the bond formed between the aluminum oxide layer formed during the treatment and the acid group of the phosphate ester molecules. In this manner, chemical bonding of the phosphorus-containing acid group of the phosphate ester molecule to the aluminum oxide surface can be assured.

To form the protective coating thereon, the aluminum surface should preferably, but not necessarily, first be mechanically or chemically cleaned to remove any surface oxides using, for example, a mineral acid such as nitric, hydrochloride, or sulfuric acid, after which the surface is rinsed with deionized water or, preferably, some of the treatment liquid.

After the aluminum surface has been cleaned, it may be immersed in the treatment liquid in an anodizing apparatus in which the treatment liquid is maintained at a temperature which may range from just above freezing to just below boiling, preferably from about 5° C to about 60° C. The temperature is selected such that the solubility of aluminum phosphate ester complexes is low.

The aluminum surface is electrically connected to the positive terminal of a power supply. A counter electrode, which is also placed into the anodizing bath, is then connected to the negative electrode of the power supply.

The cleaned aluminum surface is then anodized at a voltage, preferably a constant voltage (although alternating current, ramped, saw-toothed or combinations of voltage wave forms may be used) in the range of 1 to 400 volts, preferably from about 30 to 90 volts, depending upon the desired aluminum oxide coating thickness which will be approximately 14Å/V. The anodization is carried out until the current density falls to a level indicative of the fact that a nonporous valve metal oxide coating having a thickness of about 14 Å/V has been formed. Such a current density level may be defined as a level which may vary from about 0.3 milliamps/$cm^2$ for a pure aluminum (99.99%) to about 1.3 milliamps/$cm^2$ for a highly alloyed aluminum.

The anodizing process can be carried out at a pH in the range of 0.1 to 14 without any significant dissolution of the barrier oxide by the anodizing electrolyte. Normally, anodizing at a pH in the range of 0.1 to 4.5 or 8 to 14 results in severe dissolution of barrier oxide as it is formed. This is accomplished by the use of a functionalized layer which attaches to the surface of oxide layer on the aluminum, for example. That is, the functionalized layer resists or prevents the electrolyte from dissolving the dense, non-porous barrier-type oxide. Thus, the barrier-type oxide layer grows until current passage therethrough approaches zero at a given voltage.

The non-porous oxide layer on aluminum can have a density range from 2.8 to 3.2 gms/cc.

The thickness of the duplex layer can range from 100 to 5000Å and typically in the range of 400 to 1000Å.

The functionalized layer is less than 200Å thick and usually less than 100Å thick, with a typical thickness being about 30Å.

The dielectric constant can be as high as 25 Å/V but preferably is in the range of 12 to 16 Å/V, depending on the alloy, but typically is in the range of 13.8 to 14.2 Å/V for aluminum. Further, the oxide layer has a weight gain of less than 0.9 mg/coulomb and preferably has a weight gain in the range of 0.03 to 0.2 mg/coulomb with a typical weight gain in the range of 0.08 to 0.I mg/coulomb.

The result is an aluminum surface having a protective coating formed thereon and bonded to the aluminum surface comprising a first layer of anodically formed nonporous dense aluminum oxide and a layer of phosphate esters bonded to the aluminum oxide layer.

With respect to the bonding of the phosphate ester molecules to the aluminum oxide surface, while we do not wish to be bound by any particular theory of bonding, a layer of phosphate esters is formed uniformly on the passivation oxide at the onset of anodization. The phosphate ester layer permits the field-driven diffusion of oxygen and hydroxyl ions into the forming oxide barrier film, but does not allow access of the acidic liquid to the oxide film. Thus, a nonporous barrier, dense oxide layer is formed beneath the layer of phosphate ester groups.

The thickness of the resulting phosphate ester layer chemically bonded to the anodically formed aluminum oxide surface is in the range of 3–5000Å and preferably 5 to 500Å. The phosphorus to aluminum ratio can range from 0.001 to 0.5, preferably 0.05 to 0.2.

The acids are not incorporated into the oxide barrier layer but are bonded on the surface of the layer thereby protecting the oxide from dissolution by the electrolyte.

Figure 2:
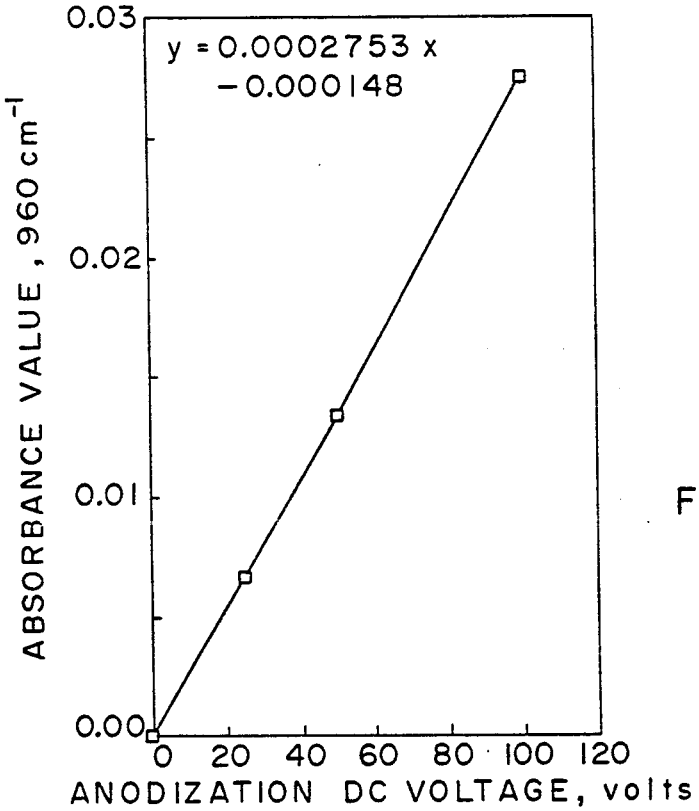
FIGS. 2, 3 and 4 are graphs showing that the aluminum oxide increases in thickness with an increase in voltage using different electrolytes.
Figure 3:
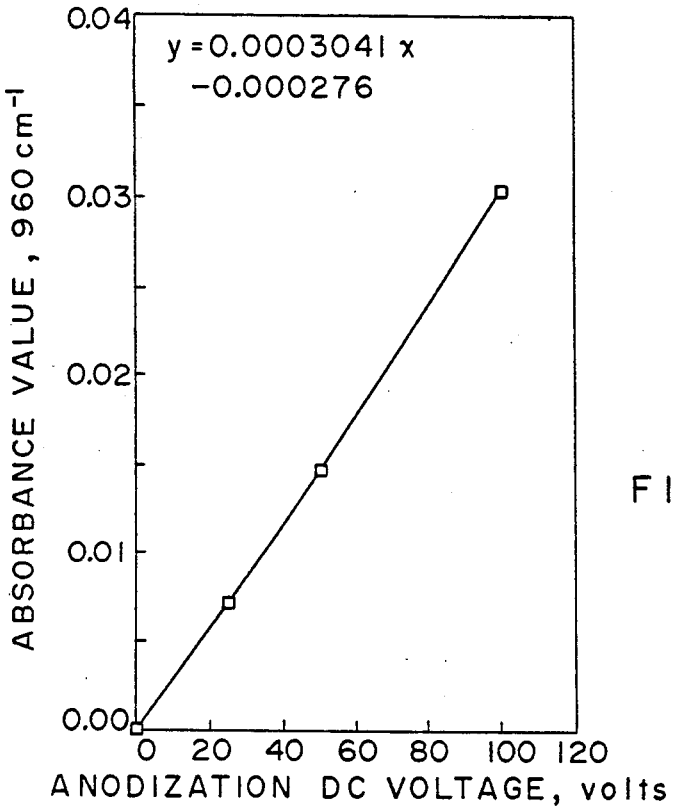

Further evidence that the functional layer is present on the surface of the oxide layer and not incorporated into the oxide layer is shown in FIG. 3, for example, which shows an increase in aluminum oxide with increase in anodizing voltage. No infrared bands due to hydrocarbon being incorporated into the oxide layer was observed. For FIGS. 2, 3 and 4, aluminum samples were anodized in 0.1 M phenylphosphoric acid, phenylphosphate dimethyl ester and phenylphosphate disodium salt, respectively and the resulting coatings were examined by (Fourier Transform Infrared Spectrometry (FTIR). The functionalized layer remains on the surface and is not incorporated in the oxide layer.

Figure 4:
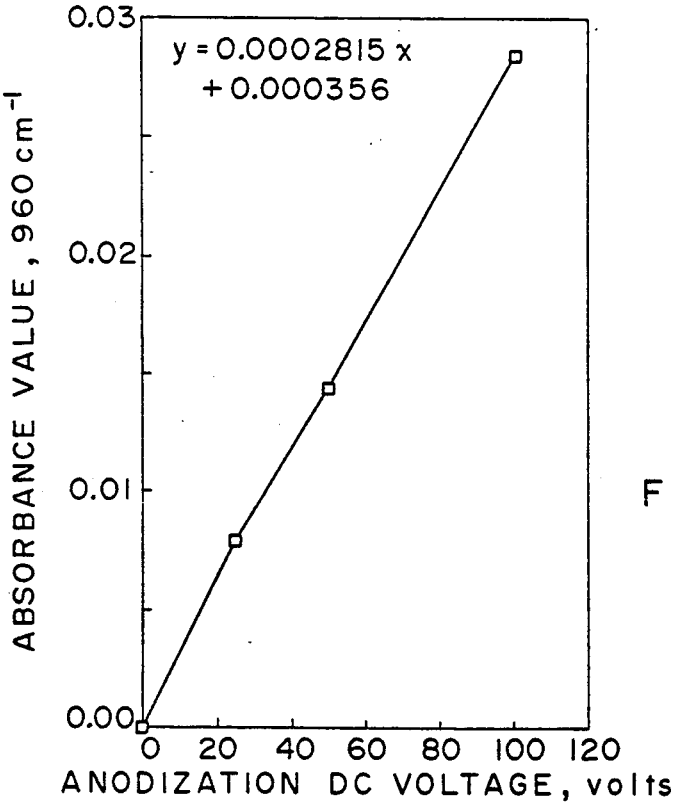

FIGS. 2, 3 and 4 are illustrative of the increase in aluminum oxide thickness with increase in voltage. It is believed that the functionalized layer remained about the same thickness even though the voltage was increased.

The properties of the functionalized outermost layer may be controlled for specific applications. Properties such as wetting, chemical reactivity, polarity, hydrophobicity, hydrophilicity can affect the performance for the intended application. For example, a functionalized layer can be used for improved adhesive bonding of polymers. Adhesives which may be used for the functionalized layer include hot-melt adhesives such as polyethylene, other polyolefins or mixtures, ethylene-vinyl acetate copolymers, polyamides, polyesters, block copolymer rubbers; solution adhesives (water soluble) such as phenolics, amino resins, poly (vinyl methyl ether), poly (vinyl alcohol), dextrin, natural proteinaceous products such as blood, fish glue and casein; solution adhesives (organic solvent soluble) such as natural rubber and other elastomers, acrylics, polyurethanes, polyamides, phenoxies, poly (vinyl acetals), polystyrenes; contact adhesives such as mixtures of chloroprene or nitrile rubber with oil-soluble phenolic, resins; aqueous dispersions such as acrylics, chloroprene, poly (vinyl acetate), polyurethanes, epoxies, silicones; activated adhesives such as dextrins, animal glues, poly (vinyl alcohol), rubber, vinyl formal polymers, phenoxies, cellulosics, poly (vinyl chloride); film adhesives such as epoxies, phenolics, nitrile elastomer and blends thereof, polyamides, poly (vinyl butyral) poly (vinyl chloride), ethylene-carboxylic acid copolymers; reactive polymers (thermosets) such as polyimide, polybenzimidazole, epoxies, phenolics, polyurethanes, cyanoacrylates, anaerobic acrylics; reactive polymers (electron beam or ultraviolet light) such as urea-formaldeyde, phenolics; pressure sensitive such as tackified elastomers, poly (alkyl acrylates), silicones.

Adhesion may result from mechanical anchoring of the adhesive in pores in irregularities of the substrate, from Coulombic attraction, adsorption (van der Waal's forces, dipole attraction, London dispersion effects) and from mutual penetration of adhesive and substrate or interdiffusion.

The functionalized layer can provide an excellent surface for adhesion of: paints, primers, architectural paints such as organic solvent thinned paints, shellacs, cellulose derivatives, acrylic resins, vinyl resins, bitumens, and water thinned paints (latexes) such as copolymers of butadiene and styrene, polyvinyl acetate, acrylic resin; commercial finishes such as air-drying finishes such as epoxies, urethanes, polyester resins, alkyds, modified rubbers, and baking finishes such as acrylic resins, phenolic resins; industrial coatings such as corrosion resistant coatings, phenolic resins, chlorinated rubber, coal tar, epoxies, epoxies cured from a solvent solution with polyfunctional amines, polyamide resins, vinyl resin, elastomers, polyesters, and polyurethanes, and high temperature coatings such as silicone rubber, silicone resins, polyamides, TFE polymers; and immersion service coatings such as asphalt, thermoplastic coal tar, epoxy-furans, amine-cured epoxies, fluorocarbons, furfuryl alcohol resins, neoprene, bake unmodified phenolics, unsaturated polyesters, polyether resins, low-density polyethylene, chlorosulfonated polyethylene, polyvinyl chloride plastisols, resinous cements, rubber, urethanes.

Thus, it will be seen that valve metal surfaces can be modified by the use of the functionalized layer to achieve higher performance in all types of bonding.

Sheet stock produced in accordance with the present invention is suitable for use for can bodies and as end stock for easy open ends particularly when coated with a polymeric material. Such polymeric materials can be applied to the duplex coatings of the invention with resulting superior bond strengths, particularly if such polymeric coatings are bonded using reactive groups on the functionalized layer. Polymeric coatings which may be used as can stock are described in U.S. Pat. No. 3,832,962, incorporated herein by reference.

EXAMPLE 1

Three specimens of high purity aluminum (99.9 wt.% Al) were provided in mill finish and vapor degreased in trichloroethylene for 5 minutes. Thereafter, they were etched in $HF/HNO_3$ etch solution, then anodized at 25, 50 and 100 V in an aqueous solution containing 0.1 M phenylphosphoric acid, pH=1.67, at a temperature of 23° C. Anodizing was carried out until the current flow approached zero which was less than 0.1, 0.2 and 0.3 minutes, respectively. The duplex layer (oxide layer and functionalized layer) had thicknesses of about 350, 700 and 1400Å, respectively.

EXAMPLE 2

This Example was run the same as Example 1 except the solution contained phenylphosphate disodium salt, pH=9.76. The thickness of the duplex coatings were 350, 700 and 1400Å, respectively.

EXAMPLE 3

This Example was the same as Examples 1 and 2 except the solution contained phenylphosphoric acid dimethyl ester, pH=2.72. The duplex coating thicknesses were 350, 700 and 1400Å, respectively.

Having thus described the invention, what is claimed is:

1. A method of producing a functionalized layer and a non-porous barrier oxide layer on a valve metal substrate, the barrier layer between the substrate and the functionalized layer, the method comprising the steps of:

(a) providing said metal substrate as an anode in an anodizing electrolyte solution comprised of a phosphorus-soluble containing compound selected from the group consisting of phosphoric acid esters and salts thereof;

(b) anodizing said substrate at a weight gain rate in the range of 0.03 to 0.2 mg/coulomb under constant voltage conditions at 13.8 to 14.2 Å/V to form a non-porous barrier valve metal oxide layer on said substrate and a functionalized layer on a surface of said oxide layer; and (c) growing the non-porous barrier oxide layer in thickness during said anodizing while maintaining the functionalized layer at a controlled thickness, the functionalized layer and oxide layer having a phosphorus to aluminum ratio in the range 0.001 to 0.5, the functionalized layer protecting said oxide layer against chemical attack by said electrolyte during anodizing.

2. The method in accordance with claim 1 wherein said valve metal is selected from the class consisting of aluminum, niobium, tantalum, titanium or zirconium, alloys of two of more of such metals, and alloys of one or more of such metals together with one or more alloying metals selected from the class consisting of silicon, iron, copper, manganese, molybdenum, chromium, nickel, zinc, vanadium, titanium, boron, lithium and zirconium.

3. The method in accordance with claim 1 wherein said electrolyte comprises a solution having a concentration ranging from about 0.001 molar to a saturated solution of said soluble phosphorus-containing compound.

4. The method in accordance with claim 3 wherein said electrolyte comprises an aqueous solution having a concentration ranging from about 0.1 to about 2 molar of said material.

5. The method in accordance with claim 3 wherein said electrolyte comprises a phosphorus-containing compound selected from the class consisting of:

(a) a 1-30 carbon phosphoric acid ester having the formula $ROPO(OH)_2$ where R is a 1-30 carbon-containing monomeric radical;

(b) a 2-30 carbon phosphoric acid ester having the formula ROR'OPO(OH) where R or R' is a 1-30 carbon-containing radical;

(c) a 3-30 carbon phosphoric acid ester having the formula ROR'OR''OPO where R, R' or R'' is a 1-30 carbon-containing radical;

(d) a phosphoric acid ester salt having the formula $ROPO(OX)_2$ where x is selected from the group consisting of ammonia, alkali, alkaline earth and transition metals;

(e) a phosphoric acid ester having the formula selected from $(RO)_m[PO(OH)_2]_n$ or $(RO)_m(R'O)_k[PO(OH)]_n$ or $(RO)_m(R'O)_k(R''O)_q[PO]_n$ wherein R is one or more radicals having a total of 1-30 carbons; R' and R'' is one or more radicals having a total of 1-30 carbons; m, k or q is the number of radicals RO, R'O or R''O, respectively, in the molecule and is in the range of 1-12; n is the number of phosphoric acid groups in the molecule and is in the range of 1–12; and (f) mixtures of the same.

6. The method in accordance with claim 3 wherein said electrolyte comprises an aqueous solution of a monomeric phosphoric acid ester having the formula $ROPO(OH)_2$ where R is a 2-12 carbon-containing monomeric radical.

7. The method in accordance with claim 3 wherein said electrolyte comprises an aqueous solution of a monomeric phosphoric acid ester having the formula ROR'(OPO(OH) where R or R' is a 1-carbon-containing radical.

8. A method of producing a functionalized layer and a non-porous barrier oxide layer on an aluminum substrate, the barrier layer between the substrate and the functionalized layer, the method comprising the steps of:

(a) providing an aluminum substrate as an anode in an anodizing electrolyte comprised of a phosphorus-containing material selected from the group consisting of phosphoric acid esters and salts thereof; and (b) anodizing said substrate at a weight gain rate in the range of 0.03 to 0.2 mg/coulomb under constant voltage conditions at 13.8 to 14.2 Å/V to form a non-porous barrier aluminum oxide layer on said aluminum substrate and a functionalized layer on a surface of said barrier layer, the functionalized layer comprised of a phosphate ester, the functionalized layer and oxide layer having a phosphorus to aluminum ratio in the range 0.001 to 0.5, the functionalized layer protecting said oxide layer against chemical attack by said electrolyte during anodizing.

9. The method in accordance with claim 8 wherein the oxide layer is produced at a weight gain rate in a range of 0.08 to 0.1 mg/coulomb.

10. The method in accordance with claim 8 wherein said electrolyte comprises an aqueous solution having a concentration ranging from about 0.001 molar to a saturated solution of said phosphorus-containing compound.

11. The method in accordance with claim 8 wherein said electrolyte comprises an aqueous solution having a concentration ranging from about 0.1 to about 2 molar of said phosphorus-containing compound.

12. The method in accordance with claim 8 wherein said electrolyte comprises a phosphorus-containing compound selected from the class consisting of:

(a) a 1–30 carbon phosphoric acid ester having the formula $ROPO(OH)_2$ where R is a 2–30 carbon-containing monomeric radical;

(b) a 2–30 phosphoric carbon acid ester having the formula ROR'OPO(OH) where R or R' is a 1–30 carbon-containing radical;

(c) a 3–30 phosphoric acid ester having the formula ROR'OR''OPO where R, R' or R'' is a 1–30 carbon-containing radical;

(d) a phosphoric acid ester salt having the formula $ROPO(OX)_2$ where x is selected from the group consisting ammonia, alkali, alkaline earth and transition metals;

(e) a phosphoric acid ester having the formula selected from $(RO)_m[PO(OH)_2]_n$ or $(RO)_m(R'O)_k[PO(OH)]_n$ or $(RO)_m(R'O)_k(R''O)_q[PO]_n$ wherein R is one or more radicals having a total of 1–30 carbons; R' and R'' is one or more radicals having a total of 1–30 carbons; m, k or q is the number of radicals RO, R'O or R''O, respectively, in the molecule and is in the range of 1–12; n is the number of phosphoric acid groups in the molecule and is in the range of 1–12; and (f) mixtures of the same.

13. The method in accordance with claim 8 wherein the aluminum substrate is sheet stock fabricated from an aluminum alloy selected from the group consisting of AA3000 and AA5000 series alloys.

14. The method in accordance with claim 13 wherein the sheet stock is selected from the group consisting of AA5182 and AA 5352 and formed into ends for beverage containers.

15. The method in accordance with claim 8 wherein the aluminum substrate is foil stock fabricated from an aluminum alloy selected from the group consisting of AA1000 and AA3000 series alloys.

16. The method in accordance with claim 8 wherein the oxide layer has a density of 2.8 to 3.2 gms/cc.

17. The method in accordance with claim 8 wherein the oxide layer has a thickness of 100 to 5000Å.

18. The method in accordance with claim 8 wherein the functionalized layer has a thickness of less than 200Å.

19. The method in accordance with claim 8 wherein the functionalized layer has a thickness of less than 100Å.

20. The method in accordance with claim 8 wherein the functionalized layer has a thickness of less than 30Å.

21. The method in accordance with claim 8 wherein the functionalized layer and the oxide layer have a phosphorus to aluminum ratio of 0.05 to 0.2.

22. A method for producing a functionalized layer and a non-porous barrier oxide layer on an aluminum sheet stock fabricated from an Aluminum Association alloy selected from the group consisting of AA5182, AA5042, AA5082 and AA5352, the barrier layer between the substrate and the functionalized layer, the method comprising the steps of:

(a) providing an aluminum substrate as an anode in an anodizing electrolyte comprised of a water containing solution having a monomeric phosphorus-containing compound selected from the group consisting of phosphoric acid esters and salts thereof; and (b) anodizing said substrate under constant voltage conditions to form a non-porous barrier aluminum oxide layer having a density of 2.8 to 3.2 gms/cc and having a thickness of 100 to 5000Å on said aluminum substrate and a functionalized layer on a surface of said barrier layer, the functionalized layer having a thickness of less than 200Å, the oxide and functionalized layer having a phosphorus to aluminum ratio of 0.001 to 0.5;

(c) whereby the oxide layer is formed at 13.8 to 14.2 Å/V and at a weight gain rate in the range of 0.03 to 0.2 mg/coulomb, the chemically resistant functionalized layer protecting said oxide layer against chemical attack by said electrolyte during anodizing.

23. The method in accordance with claim 22 wherein both layers have a phosphorus to aluminum ratio in the range of 0.05 to 0.2.

24. The method in accordance with claim 22 wherein the weight gain rate is in the range of 0.08 to 0.1 mg/coulomb.

25. A method for producing a polymer coated aluminum substrate by providing a functionalized layer and non-porous barrier oxide layer on an aluminum substrate, the barrier layer intermediate the substrate and the functionalized layer, the method comprising the steps of:

(a) providing said aluminum member substrate as an anode in a solution containing a phosphorus-containing material selected from the group consisting of phosphoric acid esters and salts thereof and combinations thereof;

(b) anodizing said substrate under constant voltage conditions at 13.8 to 14.2 Å/V to form a non-porous barrier aluminum oxide layer on said aluminum substrate at a weight gain rate in the range of 0.03 to 0.2 mg/coulomb and a functionalized layer on a surface of said barrier layer, the functionalized layer and oxide layer having a phosphorus to aluminum ratio in the range 0.001 to 0.5, the functionalized layer protecting said oxide layer against chemical attack by said electrolyte during anodizing; and (c) bonding a polymer coat to said functionalized layer to provide a polymer coated aluminum substrate.

26. The method in accordance with claim 25 wherein said electrolyte comprises an aqueous solution having a concentration ranging from about 0.001 molar to a saturated solution of said phosphorus-containing compound.

27. The method in accordance with claim 26 wherein said electrolyte comprises forming an aqueous solution having a concentration ranging from about 0.1 to about 2 molar of said phosphorus-containing compound.

28. The method in accordance with claim 26 wherein said electrolyte comprises a water soluble monomeric phosphorus-containing compound selected from the class consisting of:

(a) a 1-30 carbon phosphoric acid ester having the formula $ROPO(OH)_2$ where R is a 1-30 carbon-containing monomeric radical;

(b) a 2-30 carbon phosphoric acid ester having the formula ROR'OPO(OH) where R or R' is a 1-30 carbon-containing radical;

(c) a 3-30 carbon phosphoric acid ester having the formula ROR'OR''OPO where R, R' or R'' is a 1-30 carbon-containing radical;

(d) a phosphoric acid ester salt having the formula $RPOP(OX)_2$ where x is the group consisting of selected from ammonia, alkali, alkaline earth and transition metals;

(e) a phosphoric acid ester having the formula selected from $(RO)_m[PO(OH)_2]_n$ or $(RO)_m(R'O)_k[PO(OH)]_n$ or $(RO)_m(R'O)_k(R''O)_q[PO]_n$ wherein R is one or more radicals having a total of 1-30 carbons; R' and R'' is one or more radicals having a total of 1-30 carbons; m, k or q is the number of radicals RO, R'O or R''O, respectively, in the molecule and is in the range of 1-12; n is the number of phosphoric acid groups in the molecule and is in the range of 1-12; and (f) mixtures of the same.

29. The method in accordance with claim 25 wherein the aluminum substrate is sheet stock fabricated from an aluminum alloy selected from the group consisting of AA3000 and AA5000 series alloys.

30. The method in accordance with claim 29 wherein the sheet stock is selected from the group consisting of AA5182 and AA5352 and formed into ends for beverage containers.

31. The method in accordance with claim 25 wherein the aluminum substrate is foil stock fabricated from an aluminum alloy selected from the group consisting of AA1000 and AA3000 series alloys.

32. The method in accordance with claim 25 wherein the oxide layer has a density of 2.8 to 3.2 gms/cc.

33. The method in accordance with claim 25 wherein the oxide layer has a thickness of 100 to 5000Å.

34. The method in accordance with claim 25 wherein the functionalized layer has a thickness of less than 200Å.

35. The method in accordance with claim 30 wherein the functionalized layer has a thickness of less than 100Å.

36. The method in accordance with claim 25 wherein the functionalized layer has a thickness of less than 30Å.

37. The method in accordance with claim 25 wherein the functionalized layer and the oxide layer have a phosphorus to aluminum ratio of 0.05 to 0.2.

38. A method of producing a polymer coated aluminum substrate by providing a functionalized layer and a non-porous barrier oxide layer on an aluminum flat rolled product fabricated from an Aluminum Association alloy selected from the group consisting of AA1000, AA3000 and AA5000 type alloys, the barrier layer intermediate the substrate and functionalized layer, the method comprising the steps of:

(a) providing an aluminum substrate as an anode in an anodizing electrolyte comprised of a phosphorus-containing material selected from the group consisting of phosphoric acid esters and salts thereof;

(b) anodizing said substrate under constant voltage conditions at 13.8 to 14.2 Å/V to form a non-porous barrier aluminum oxide layer at a weight gain rate in the range of 0.03 to 0.2 mg/coulomb on said aluminum substrate and a functionalized layer on a surface of said barrier layer, the functionalized layer comprised of a phosphate ester, the functionalized layer and oxide layer having a phosphorus to aluminum ratio in the range 0.001 to 0.5, the functionalized layer protecting said oxide layer against chemical attack by said electrolyte during anodizing; and 39. The method in accordance with claim 38 wherein both layers have a phosphorus to aluminum ratio in the range of 0.05 to 0.2.

40. The method in accordance with claim 38 wherein the functionalized layer remains relatively constant in thickness during anodizing and the oxide layer grows in thickness during anodizing.

* * * * *

UNITED STATES PATENT AND TRADEMARK OFFICE

CERTIFICATE OF CORRECTION

PATENT NO. : 5,102,507

DATED : April 7, 1992

INVENTOR(S) : Larry F. Wieserman, Karl Wefers, Gary A. Nitowski

It is certified that error appears in the above-identified patent and that said Letters Patent is hereby corrected as shown below:

| | |
|---|---|
| Abstract, line 7 | Change "phosphorus" to --phosphoric-- |
| Col. 5, line 61 | Change "0.I" to --0.1-- |
| Claim 1, Col. 8, line 10 | Change "phosphorus-soluble" to --soluble phosphorus- -- |
| Claim 12, Col. 9, 1. 52 | Change "2-30" to --1-30-- |
| Claim 12, Col. 9, 1. 54 | Change "phosphoric carbon" to --carbon phosphoric-- |
| Claim 12, Col. 9, 1. 57 | After "3-30" insert --carbon-- |
| Claim 25, Col. 11, 1. 7 | After "aluminum" delete "member" |
| Claim 27, Col. 11, 1. 34 | Delete "forming" |
| Claim 28, Col. 11, 1. 51 | Change "$RPOP(OX)_2$" to --$ROPO(OX)_2$-- |
| Claim 28, Col. 11, 1. 51 | After "is" insert --selected from-- |
| Claim 28, Col. 11, 1. 52 | Delete "selected from" |

UNITED STATES PATENT AND TRADEMARK OFFICE

CERTIFICATE OF CORRECTION

PATENT NO. : 5,102,507

DATED : April 7, 1992

INVENTOR(S) : Larry F. Wieserman, Karl Wefers, Gary A. Nitowski

It is certified that error appears in the above-identified patent and that said Letters Patent is hereby corrected as shown below:

| | |
|---|---|
| Claim 35, Col. 12, l. 23 | Change "30" to --25-- |
| Claim 38, Col. 12, l. 36 | Change "type" to --series-- |
| Claim 38, Col. 12, l. 54 | After "and" insert --(c) bonding a polymer coat to said functionalized layer to provide a polymer coated aluminum substrate-- |

Signed and Sealed this

Fifteenth Day of June, 1993

Michael K. Kirk

*Attest:*

MICHAEL K. KIRK

*Attesting Officer*

*Acting Commissioner of Patents and Trademarks*